US005312704A

United States Patent [19]

Fuller et al.

[11] Patent Number: 5,312,704

[45] Date of Patent: May 17, 1994

[54] MONOMODAL, MONODISPERSE TONER COMPOSITIONS AND IMAGING PROCESSES THEREOF

[75] Inventors: Timothy J. Fuller, W. Henrietta; Ralph A. Mosher, Rochester; Anita C. Van Laeken, Macedon, all of N.Y.

[73] Assignee: Xerox Corporation, Stamford, Conn.

[21] Appl. No.: 78

[22] Filed: Jan. 4, 1993

[51] Int. Cl.[5] ..... G03G 9/087

[52] U.S. Cl. ..... 430/45; 430/110; 430/109

[58] Field of Search ..... 430/45, 106, 109, 110, 430/111

[56] References Cited

U.S. PATENT DOCUMENTS 4,703,090 10/1987 Ferraresi et al. ..... 525/246

5,229,242 7/1993 Mahabadi et al. ..... 430/110

*Primary Examiner*—John Goodrow

*Attorney, Agent, or Firm*—John L. Haack; Eugene O. Palazzo

[57] ABSTRACT

A toner composition comprised of pigment particles, and a resin comprised of a monomodal polymer resin or monomodal polymer resin blends and wherein the monomodal resin or resin blends possess a narrow polydispersity.

26 Claims, 3 Drawing Sheets

MONOMODAL, MONODISPERSE TONER COMPOSITIONS AND IMAGING PROCESSES THEREOF

BACKGROUND OF THE INVENTION

This invention is generally directed to toner and developer compositions, and, more specifically, the present invention is directed to toner compositions and imaging processes thereof. In embodiments, there are provided in accordance with the present invention toner compositions containing copolymer resins or copolymer resin blends which are monomodal or possess a nearly monodisperse molecular weight distribution characteristic. In another embodiment, toner resins of the instant invention provide an optimum combination of mechanical and rheological properties, low melt viscosity and melt fluidity, low fusing temperatures and broad fusing latitudes. In another embodiment, there are provided in accordance with the present invention, imaging processes with toner compositions having fused toner images with gloss characteristics, measured by a gloss meter, that are determined by the molecular weight properties of the resin copolymer and copolymer resin blends selected.

Preferred low melt xerographic toners compositions of the instant invention are formulated with monomodal resins or blends thereof. Monomodal resins of the instant invention have a single peak, as determined using gel permeation chromatography analysis, and have a polydispersity or ratio of weight average molecular weight $M_w$ and number average molecular weight $M_n$ of between 1 and 3 and preferably between 1 and 2. Resins which are monomodal and monodisperse or substantially monodisperse provide optimum combinations of the aforementioned properties and afford a simple and convenient means by which to control the gloss characteristics of fused toner images. The ability to control the gloss characteristics of fused toner images is important for achieving, for example, high quality gloss characteristics in xerographic pictorial color applications and high quality matte finish characteristics in black or monochrome applications. Moreover, high projection efficiency with transparencies requires smooth, high gloss images to reduce scattering of incident light on image surfaces. The resins of the present invention allow the formation of matte text images and glossy pictorial images made with different toners when fused under the same fusing temperature conditions.

One presumption in the field of xerographic image fusing according to U.S. Pat. Nos. 4,973,538, 4,795,689, 4,386,147, 4,499,168, 4,910,114, 4,968,574, 5,001,031, 4,917,984, and 5,057,392 is that toner compositions having desirable broad fusing latitudes are obtained with polymers or copolymers and blends thereof having broad molecular weight distributions or large polydispersity values. A seemingly plausible rationale for this presumption is that high molecular weight macromolecules with high melt viscosities will blend with and tend to rheologically reinforce lower molecular weight macromolecules having lower melt viscosities. The presumed reinforced blend thereby prevents offsetting of the lower molecular weight, lower melt viscosity macromolecule component of toner images from a receiver sheet to a fuser roll in a conventional xerographic thermal fusing process step. This aforementioned presumption has further led to the deliberate preparation of toner polymers having broad molecular weight distributions and to toner developer materials designs having at least some very high molecular weight polymer component to reinforce lower molecular weight components.

For example, U.S. Pat. Nos. 4,973,538, 4,795,689, 4,386,147, 4,910,114, 4,968,574, 5,001,031, 4,917,984, and 5,057,392, teach a reinforced melt concept wherein a number of multimodal toner polymers are indicated to provide unique broad fusing latitude performance. It is now evident from applying the resin compositions and processes of the present invention that broad molecular weight distributions may not be necessary to obtain broad fusing latitudes and that broad molecular weight distributions can, in instances, actually adversely affect the desired high gloss characteristics of the fused toner images when fused under conventional roll fusing system conditions.

In embodiments, the preparative processes of the present invention comprise preparing a monomodal-monodisperse copolymer toner resin by copolymerizing olefin containing monomers such as styrene and butadiene, for example, in a non-aqueous medium with preferably an anionic polymerization initiator, by cooling between −40° and 0° C. in 25 weight percent tetrahydrofuran and 75 weight percent cyclohexane solvent system for several hours. Monomodal and monodisperse resins are formed, for example, poly(styrene-butadiene) having a molecular weight range from about 5,000 to about 75,000 and a polydispersity ($M_w/M_n$) of from 1.0 to about 2.0. Adding and dispersing pigment particles and known performance additives in the copolymer resin or a blend of two or more monomodal resins affords toner compositions having the aforementioned advantages. The resins may be processed into toner particles by conventional melt-mixing methods followed by conventional jet mill attrition techniques.

The resulting toners and developer compositions can be selected for known electrophotographic imaging and printing processes, especially dry and liquid development xerographic imaging and printing processes, including color processes, and lithography.

In some xerographic systems wherein process color is a necessity such as pictorial color applications, toners having low fusing temperatures such as from about 100° to about 140° C. are preferable, for example, to avoid paper curling and to maximize gloss properties. Lower fusing temperatures minimize the loss of moisture from paper, thereby reducing or eliminating paper curl. Furthermore, in process color applications and especially in pictorial color applications, high gloss is often necessary, as well as high projection efficiency properties for transparency images.

Numerous processes are known for the preparation of toners, such as, for example, conventional processes wherein a resin is melt kneaded or extruded with a pigment, micronized and pulverized to provide toner particles. Additionally, toners must not aggregate or block during manufacturing, transport or storage periods before use in electrographic systems and must exhibit low fusing temperature properties in order to minimize fuser energy requirements. Accordingly, toner resins exhibit glass transition temperatures of from more than about 50° C. and preferably of from more than about 55° C. to satisfy blocking requirements. This blocking requirement restricts the toner fusing properties from about 135° C. to about 160° C. In process color or pictorial applications, wherein low paper curl is a requirement, low temperature toner fusing properties are desired such as less than about 140° C. and preferably less than 110° C. such that moisture evaporation or removal from paper is minimized or preferably avoided. Toners of the present invention, fuse at relatively lower temperatures such as from about 110° to about 150° C., thereby reducing the energy requirements of the fuser and more importantly resulting in lower moisture driven off from the paper during fusing, hence lowering or minimizing paper curling necessary for pictorial applications. For the toners of the present invention, blocking, fusing, and gloss properties may be controlled by judicious selection of a monomodal resin or a blend of monomodal resins as described herein. Thus, in embodiments of the instant invention are described selection criteria for obtaining: high, intermediate and low gloss fused toner image appearance; broad and narrow toner fusing latitude as measured by crease and gloss properties; and preferred toner blocking temperature properties. The minimum fix temperatures of matte or non-glossy toner images are measured by image crease tests, whereas minimum fix temperatures of glossy pictorial images are measured using a VWR 75° gloss meter.

In general, a crease minimum fix temperature of a toner composition is dictated by the toner glass transition temperature, $T_g$, wherein lower toner $T_g$ values translate into lower crease minimum fix temperature (MFT).

The crease fusing latitude of a toner is determined by the $M_w$ of the toner resin. The higher the $M_w$ of the resin, the greater the fusing latitude of the toner. The fusing latitude of a toner approaches a maximum plateau when the weight average molecular weight of the toner resin approaches about 45,000. Thus, preferred low melt toners with respect to low crease MFT and broad fusing latitude are those toners made with the highest molecular weight resin materials which allow acceptable toner jetting rates to be maintained. Because toner jetting rates decrease logarithmically with increasing copolymer molecular weight, toner resin designs are practically limited to those resins which jet fast enough to be cost effective, that is, for example, resins with number average molecular weights less than 30,000.

For the resins with broad polydispersities evaluated in the present invention, the fusing behavior of the toner is severely limited by the lowest molecular weight components in the resin composition. Most polymers show a strong $T_g$ to molecular weight dependence in which lower molecular weight polymers have lower $T_g$ values. Consequently, most polymers with broad polydispersities are composed of both high and low $T_g$ components, and the measured Tg represents an average of all the respective $T_g$ values of all resin components. The $T_g$ of the toner resin relates to its blocking temperature. A higher toner $T_g$ translates into a higher blocking temperature. Due to a $T_g$ to molecular weight dependent relationship for most polymers, toner blocking temperature is determined primarily by the lower molecular weight components of the resin composition. In practice, a blocking temperature of 115° C. is required by toner use and storage considerations. Consequently toner resins with broad molecular weight distributions or polydispersities greater than 3 typically require $T_g$ values greater than 57° C. to satisfactorily pass a toner blocking test at 115° F. (46.1° C.). Monomodal poly(styrene-butadiene) resins with $M_n$ near 20,000 or greater require a $T_g$ of only 51.5° C. to pass the blocking test at 110° F., and 54° C. to pass the blocking test at 115° F. Similarly, Spar II resin, available from Goodyear, with $M_w$ near 8,000 and a $T_g$ of 54° C. obtained by reprecipitation to remove low molecular weight components passes the blocking test at 115° F. With the low molecular weight components present, Spar II fails the blocking test at 110° F.

The gloss properties of fused toner images are dependent on $M_w$ and $T_g$. Fused toner image gloss increases with decreasing molecular weight because it is believed low molecular weight, low viscosity polymers show increased flow when heated. Gloss at lower fusing temperatures improves with decreasing toner resin $T_g$ for the same reason. Thus, high image gloss at low fuser set temperatures is best achieved with low $M_w$ and low $T_g$ toners. By contrast, improved toner crease test fix level is best achieved with low $T_g$ and high $M_w$ toners. Thus, there is a trade off in toner properties required for matte or glossy images which must be optimized to achieve desired toner performance and multi level gloss images.

Toner resin $T_g$ is the principal determinant in toner MFT as measured by crease test properties. Toner resin $M_w$ is the principal determinant in hot offset temperature, fusing latitude and image gloss characteristics. Toners made with low $T_g$, high $M_w$ copolymers are preferred for improved fix by crease test and broad fusing latitudes. Low $T_g$ and low $M_w$ copolymers are preferred for forming high gloss images at low fusing temperatures with poor crease test fusing latitude. Low $M_w$ toner resins generally fare worse in crease tests compared with high $M_w$ toner resins. Thus, in embodiments of the present invention high gloss (low $M_w$) resin and a low gloss (high $M_w$) resins are required to provide glossy and matte image appearances, respectively, for toners fused under the same conditions. Thus, gloss and gloss fusing latitude are improved by low molecular weight polymers while fusing latitude as determined by crease test methods deteriorates. Toner resins with broad polydispersities as taught in the aforementioned prior art patents attempt to compromise between these conflicting gloss/crease toner properties but they do not represent an optimized solution. In embodiments of the present invention, superior toner materials having optimum crease and gloss performances are obtained by optimizing toner performance using monomodal, monodisperse resins. Monomodal, monodisperse resins represent an excellent compromise between the conflicting performance criteria of crease and gloss.

Polymer structure, $T_g$ and $M_w$ determine the fusing behavior of xerographic toners. Monomodal, monodisperse polymers of the present invention allow molecular weight and $T_g$ contributions to the fusing event to be separated and defined. High molecular weight components in a broad molecular weight distribution resin confer the following properties to a toner: high crease and high gloss minimum fix temperatures, because the $T_g$ and $M_w$ of the high molecular weight component are greater than low molecular weight components; broad crease fusing latitude; low gloss at low fusing temperatures; poor tape transfer test properties; good crease test; good polymer mechanical properties; slow jetting rate; high melt viscosity; non-blocking behavior; large particle toners which are difficult to form by jetting; and toner images with poor projection efficiencies unless very high fusing temperatures are used. The low molecular weight component in a broad molecular weight resin confers the following properties to a toner: low gloss and low crease minimum fix temperature, because $T_g$ and $M_w$ of this component are smaller; poor crease fusing latitude; high gloss at low fusing temperatures; good tape test properties; poor crease test properties; poor mechanical properties; fast jetting rate with the formation of small particle toner; low melt viscosity; poor toner blocking behavior; and good transparency image projection efficiency at low fusing temperatures. The use of monomodal, monodisperse resins of the present invention allows matte or glossy toner properties to be selected and tailored for optimum performance in the aforementioned toner properties and tests.

There is a very narrow window of opportunistic materials design for low melt toner properties and this window is further constrained by image appearance (gloss or matte images), fusing properties (low melt with broad fusing latitude), toner blocking temperature requirements and jetting rates. Furthermore, toner resin designs must be highly reproducible to ensure consistent low melt toner performance. The preparation of useful low melt toner materials having the aforementioned desirable or preferred properties is consistently achievable with monomodal, monodisperse resins in embodiment of the present invention.

Suitable monomodal polymer resin preparation processes include known radical, anionic, cationic, metathesis and group transfer methodologies. These polymerization processes can be either "living" or "pseudoliving" with reversibly reactive terminating end groups. A reference containing a general discussion of useful methods of polymer synthesis, characterization and evaluation is found in "Macromolecules," 2nd Edition, Vol. 1 and 2, H-G Elias, Plenum, N.Y., 1984, the disclosure of which is incorporated by reference herein in its entirety. Optimized monomodal, monodisperse resins of the present invention show better low crease and high gloss fusing properties compared with their broad molecular weight counterparts.

Anionic copolymer resins representative of preferred monomodal, monodisperse styrene-butadiene copolymer based toner composition characteristics described herein, possess fusing latitudes of between 16° C. ($M_w$ 25,080) and 46° C. ($M_w$ 62,700), compared with 40° C. for a control toner comprised of a copolymer of styrene-n-butyl methacrylate, carbon black and cetyl pyridinium chloride ($M_w$ 45,500). The $T_g$ and $M_w$ of anionic copolymers of the present invention were precisely selected and reproducibly prepared under carefully controlled conditions. Poly(styrene-butadiene) copolymer $T_g$ is highly dependent on butadiene content, molecular weight, and 1,2-vinyl content. At a fixed number of 1,2-vinyl groups, the $T_g$ of random anionic styrene-butadiene copolymers is dependent on butadiene content in the copolymer. Compared with polystyrene, the $T_g$ values of random anionic styrene-butadiene copolymers with 80 and 87 weight percent 1,2-vinyl contents are relatively insensitive to molecular weight see, for example, Example II. Toner blocking temperature is dependent on toner $T_g$. Minimum fix temperature (MFT) determined using a Xerox 1075 TM photocopier operated at 11 inches per second by 65 crease metric increases by 1.5° C. for each 1° C. increase in toner $T_g$. MFT at 65 crease is relatively insensitive to anionic copolymer $M_w$, and decreases by 0.2° C. for each 1,000 increase in copolymer $M_w$, for the anionic poly(styrene-butadiene) materials considered. Hot offset temperature (HOT) increases by 0.64° C. for each 1,000 increase in copolymer $M_w$. Fusing latitude, that is the difference between HOT and MFT, increases with increased copolymer $M_w$ and is relatively independent of copolymer $T_g$.

Blends of 10 weight percent high $M_n$ (80,000) and 90 weight percent low $M_n$ (20,000) copolymers with comparable $T_g$ values were unsuccessful combinations for enhancing toner fusing latitude. Moreover, a high $M_w$ resin component decreases toner image gloss more than that of a pure low $M_w$ component toner.

For the preparation of matte finish toner resins with broad fusing latitudes the use of silane coupling agents to couple anionic intermediate polymer resins is more effective than blending to increase copolymer $M_w$. Toners with matte finish have been described in copending U.S. Ser. No. 07/843,051 filed Feb. 28, 1992, the entire disclosure of which is incorporated herein by reference.

Although $T_g$ and $M_w$ of the resin or resin blend determine the fusing behavior of toner, these dependencies change with different polymer classes and structures. Toners made with random anionic styrene-butadiene copolymers with high 1,2-vinyl content fuse at lower temperatures than toner resins made with suspension process styrene-1,4-butadiene copolymers and styrene-n-butyl methacrylate copolymers having comparable $T_g$ values.

In a patentability search there is mentioned various patents, the disclosures of which are incorporated by reference in their entirety:

U.S. Pat. No. 4,973,538 to Suzuki et al., issued Nov. 27, 1990, assigned to Fuji Xerox, discloses a toner containing a colorant and a binder resin formed of a mixture of a low molecular weight component and a high molecular weight component. Both the low molecular weight component and high molecular weight component are made from a styrene-acrylic copolymer, wherein the weight ratio (A) of styrene to acrylic monomer in the low molecular weight polymer component and a weight ratio (B) of styrene to acrylic monomer in the high molecular weight polymer component have a relationship of $A/B > 1.3$. A weight average molecular weight ($M_w$) and a number average molecular weight ($M_n$) of the low molecular weight polymer component have a ratio ($M_w/M_n$) of less than or equal to 3.0. See Col. 4, lines 24–43. The low molecular weight controls lower temperature fixability and the high molecular weight controls anti-offsetting properties. See Col. 3, lines 35–41.

U.S. Pat. No. 4,795,689 to Matsubara et al., issued Jan. 3, 1989, discloses a toner comprising: (1) a nonlinear polymer; (2) a low-melting polymer; (3) a copolymer composed of a segment polymer which is at least compatible with the above nonlinear polymer and a segment polymer which is at least compatible with the low-melting polymer; and (4) a coloring agent. The toner has: (1) a fixability at a low temperature; (2) an anti-offset property; (3) an anti-blocking property; (4) the ability to obtain a color-tone image; (5) the ability to obtain a fogless, clear image; and (6) the ability to obtain a number of repeated copies of an image. The low melting polymer has a number average molecular weight $M_n$ of from 1,000 to 20,000 and a weight average molecular weight $M_w$ of from 2,000 to 100,000. A gel permeation chromatograph is used to measure the weight average molecular weight and the number average molecular weight.

U.S. Pat. No. 4,386,147 to Seimiya et al., issued May 31, 1983, discloses toners containing a colorant and a resin wherein the resin contains at least one particular type of polymer which has a $M_w/M_n$ ratio of about 3.5 to 40. The resin composition comprises a uniform mixture of a low polymer and a high polymer. See Col. 3, lines 11–35.

U.S. Pat. No. 4,910,114 to Hosino et al., issued Mar. 20, 1990, discloses a toner containing a polymer binder comprising a high molecular weight monofunctional monomer which exhibits good flow properties in a molten state, and improved fixing properties in a heat roll fixing process. The high molecular weight monofunctional monomer is obtained by a reaction of a polymer with a compound having an ethylenic double bond and a functional group. The toner characteristics are improved by regulating the polymerization so that the polymer may have a ratio $M_w/M_n$ of 2 to 30.

U.S. Pat. No. 4,968,574 to Morita et al., issued Nov. 6, 1990, discloses toners having a main resin component comprising a lower molecular weight polymer and a higher molecular weight polymer. The lower molecular weight has a weight average molecular weight of 50,000 or less and the higher molecular weight polymer has a weight average molecular weight of 80,000 or more. A toner resin ($M_w/M_n$) ratio may be adjusted by selecting and compounding ingredients type, composition, molecular weight, and mixing ratio. The ratio may be 3.5 or over. See Col. 3, line 59–Col. 4, line 14.

U.S. Pat. No. 5,001,031 to Yamamoto et al., issued Mar. 19, 1991, discloses an electrophotographic toner composition comprising a vinyl polymer having a number average molecular weight of 1,000 to 10,000, a weight average molecular weight/number average molecular weight ratio of 41–200, and a glass transition temperature of 50°–70° C. These may be controlled to improve a paper-surface smoothening property and low temperature fixing property, balancing an offsetting resistance at high temperature, blocking resistance, and grindability.

U.S. Pat. No. 4,917,984 to Saito, issued Apr. 17, 1990, discloses a toner composition comprising a binder resin and a dye or pigment, wherein the binder resin is a polymer synthesized from a vinylic monomer. The toner has a low fixation temperature, good offset resistance, and excellent background resistance which is provided by using mixtures of the polymer wherein its molecular weight distribution is measured by gel permeation chromatography. See Col. 2, lines 20–46.

U.S. Pat. No. 5,057,392 to McCabe et al., issued Oct. 15, 1991, discloses a low fusing temperature toner powder comprising a polyblend of a crystalline polyester and an amorphous polyester which are crosslinked with an epoxy novolac resin. The crystalline polymer melts at a relatively low temperature and has a relatively low glass transition temperature, while the amorphous polymer has a high glass transition temperature. The crystalline polyester has a number average molecular weight in the range of about 1000 to about 3000 and a weight average molecular weight in the range of about 2000 to about 6000. The amorphous polyester has a number average molecular weight in the range of about 1000 to about 3000 and a weight average molecular weight in the range of about 2000 to about 9000.

Documents disclosing toner compositions with charge control additives include U.S. Pat. Nos. 3,944,493; 4,007,293; 4,079,014; 4,394,430; and 4,560,635 which illustrates a toner with a distearyl dimethyl ammonium methyl sulfate charge additive. These toners are prepared, for example, by the usual known jetting, micronization, and classification processes. Toners obtained with these processes generally possess a toner volume average diameter of form between about 10 to about 20 microns and are obtained in yields of from about 85 percent to about 98 percent by weight of starting materials without classification procedure.

There is a need for black or colored toners wherein the aforementioned properties are controllable and preferably selectable. There is also a need for black and colored toners that are non-blocking, such as from about 115° F. to about 120° F., of excellent image resolution, non-smearing and of excellent triboelectric charging characteristics. In addition, there is a need for black or colored toners with low fusing temperature, of from about 110° C. to about 150° C., of high or selectable gloss properties such as from about 50 gloss units to about 85 gloss units, of high projection efficiency, such as from about 75 percent efficiency to about 95 percent efficiency or more, and in addition result in developed images with minimal or no paper curl or fuser roller hot offset.

SUMMARY OF THE INVENTION

It is an object of the present invention to provide toners with many of the advantages illustrated herein.

In another object of the present invention there are provided toner compositions comprised of pigment particles and polymeric resins or resin blends having low polydispersities.

In yet another object of the present invention there are provided toner compositions with high or broad fusing latitudes.

In yet another object of the present invention there are provided toner compositions with low melt viscosities.

In yet another object of the present invention there are provided toner compositions having gloss properties that are inversely proportional to the molecular weight of the polymeric resin or resin blend selected.

Another object of the present invention provides toner compositions providing images with high gloss properties such as from about 45 gloss units to about 85 gloss units.

In another object of the present invention there are provided toner compositions providing images with intermediate and low gloss properties of from about 1 to about 50 gloss units.

In yet another object of the present invention there are provided toner compositions with low fusing temperatures of from about 110° C. to about 150° C. and of excellent nonblocking characteristics at elevated temperatures of more than about 115° F. over several days.

Moreover, in another object of the present invention there are provided toner compositions providing images with high projection efficiencies such as from about 75 to about 95 percent efficiency.

Another object of the present invention resides in providing resin selection processes for the preparation of toner compositions containing monomodal polymeric resins or resin blends with narrow polydispersities that satisfy the aforementioned objects.

Also, in another object of the present invention there are provided developer compositions with toner particles having monomodal molecular weight polymeric resin or resin blends with narrow polydispersities obtained by the processes illustrated herein, carrier particles, and optional charge enhancing additives or surface additives, or mixtures of these additives.

Another object of the present invention resides in the formation of toners which will enable the development of images in electrophotographic imaging apparatuses, which images have substantially no background deposits thereon, and are of excellent resolution; and further, such toner compositions can be selected for high speed electrophotographic apparatuses, that is those exceeding, for example, 70 copies per minute.

DESCRIPTION OF DRAWINGS

Figure 1:
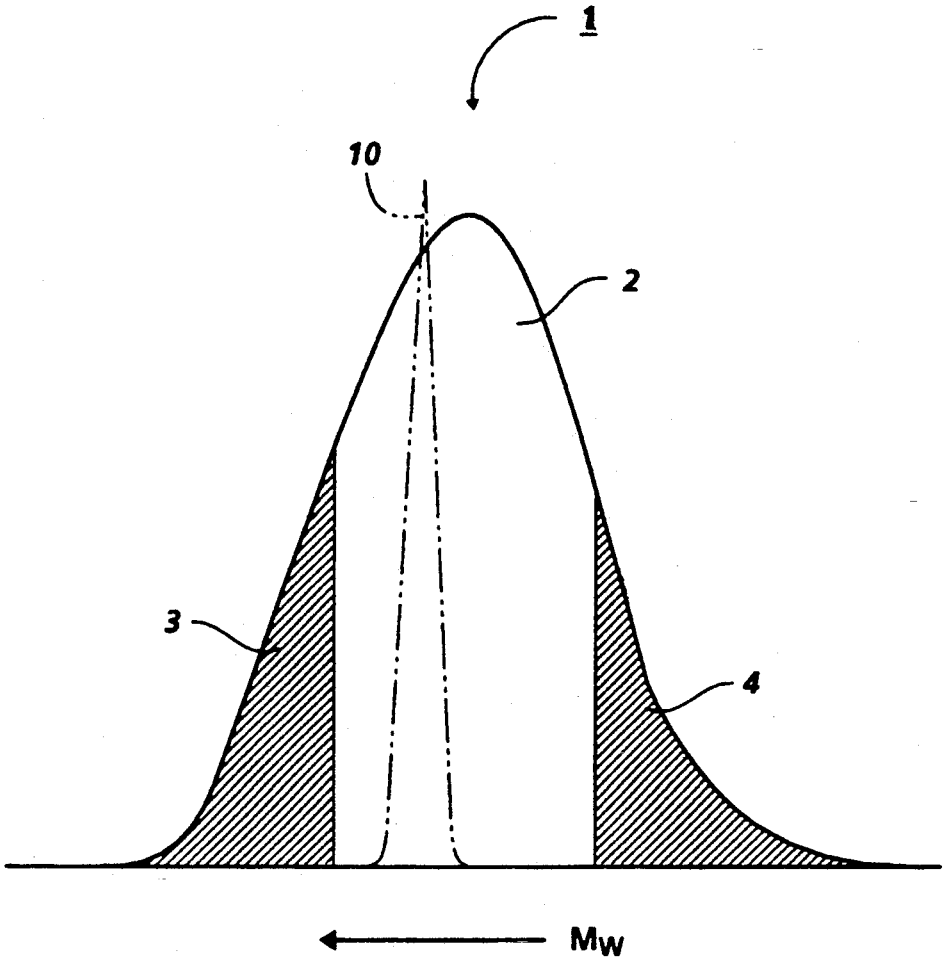
FIG. 1 represents a molecular weight ($M_w$) distribution curve for a monomodal polydisperse polymeric resin such as styrene butadiene copolymer (89:11 weight ratio) prepared by conventional means, and a monomodal, monodisperse polymeric resin prepared by the present invention as indicated herein.

FIG. 1 is a graphical representation of a hypothetical normal distribution curve expected for a monomodal homogenous polymeric or copolymeric mixture of weight average molecular weight ($M_w$) species having a broad polydispersity of, for example, 2 to 10. Referring to the Figure, the distribution curve 1 shows a polymer mixture having intermediate 2, high 3, and low 4 weight average molecular weight species. In embodiments and aspects of the present invention, processes for preparing narrow weight average molecular weight toner resins representing, for example, discrete cuts or segments 10 (broken line) of a normal molecular weight distribution curve of FIG. 1 without resorting to impractical separation schemes are disclosed. Important rheological and toner formulation properties derived from distinct low and high molecular weight monomodal, monodisperse polymer resins or resin blends are summarized in the accompanying chart, in the working Examples, and in Tables 1, 2 and 3.

Figure 2:
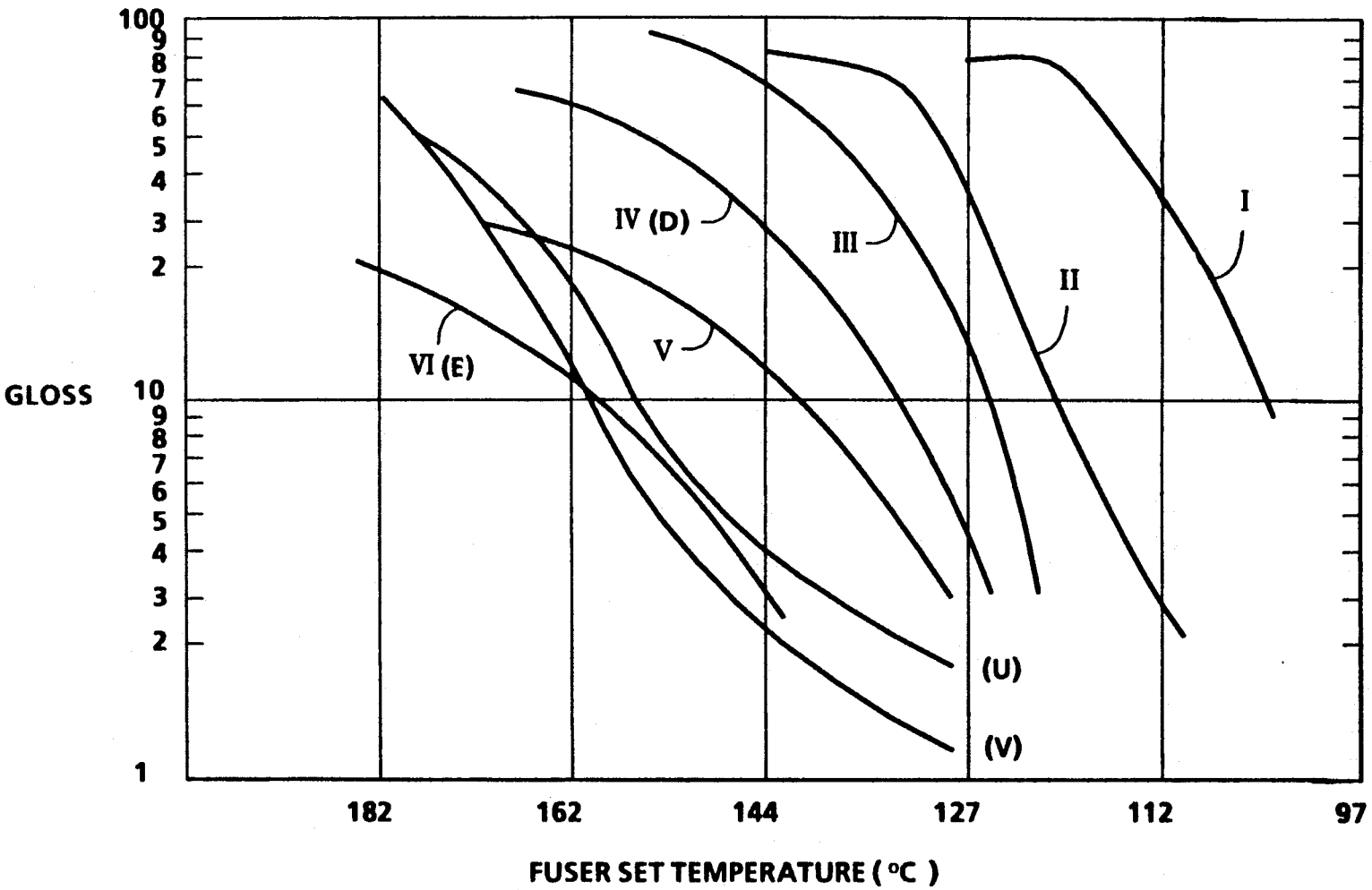
FIG. 2 illustrates the relationship between toner resin gloss properties and fuser set temperatures.

FIG. 2 is a graphical representation of the relationship between gloss (log scale) properties, in particular gloss 10 values, of various toner compositions when fixed to paper receiver sheets and fuser set temperature (degrees Centigrade scale). The various toner formulations represented by Roman numerals in FIG. 2 are described more fully in Table 2. The data indicate that gloss properties are proportional to the glass transition temperature, $T_g$, and the weight average molecular weight ($M_w$) of the toner resin. Crease minimum fix temperature is dependent on toner $T_g$. Thus, all the toners in FIG. 2 have the same crease minimum fix temperatures since all have nearly the same $T_g$, about 53°±1.5° C.; however, each has markedly different gloss profile which is controlled by $M_w$. This relationship expresses a concept of "dial-a-gloss" for toner compositions, that is, the gloss properties of a toner image may be selected or controlled to a high degree of certainty by judicious choice of a narrow $M_w$ resin or resin blend of the present invention.

| Property | High $M_w$ Component | Low $M_w$ Component |
|---|---|---|
| Fusing Temperature | High | Low |
| Fusing Latitude | Broad | Narrow |
| Gloss | Low | High |
| Tape Transfer Test | Poor | Good |
| Crease Test | Good | Poor |

-continued

| Property | High $M_w$ Component | Low $M_w$ Component |
|---|---|---|
| Mechanicals | Good | Poor |
| Jetting Rate | Slow | Fast |
| Melt Viscosity | High | Low |
| Blocking | Good (None) | Poor |
| Toner Particle Size | Large | Small |
| Transparency Projection Efficiency | Poor | Good |

Figure 3:
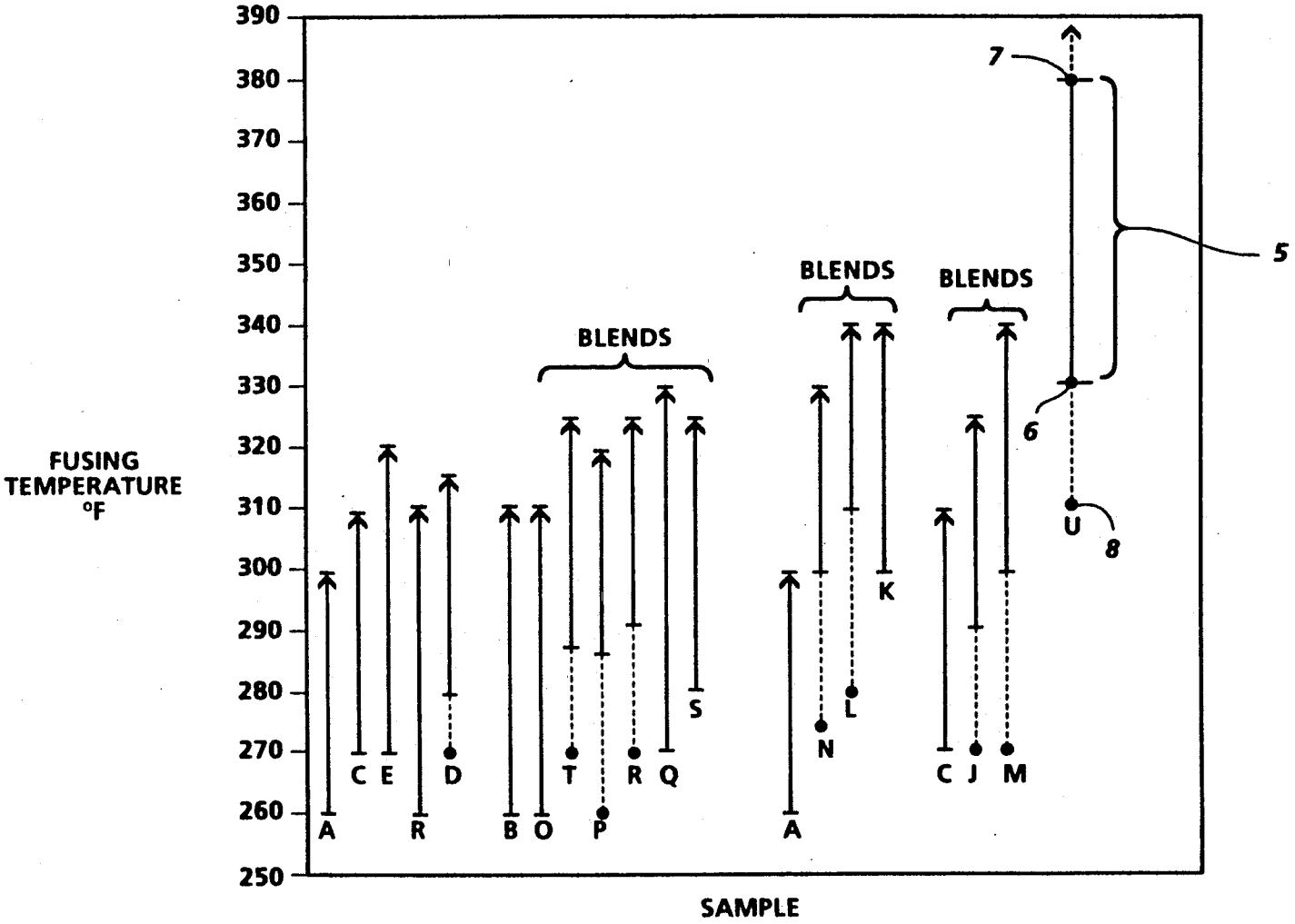
FIG. 3 illustrates the fusing latitude temperature ranges for monomodal resins and resin blends with narrow polydispersities of the present invention.

FIG. 3 is a graphical representation of the fusing latitude (in degrees Fahrenheit) of toners made with various monomodal resins and their corresponding blends designated with capital letters and which compositions are tabulated in Table 1. Referring to the Figure, the fusing latitude 5 is the temperature range between a minimum fix temperature (M.F.T.) 6 and a hot offset temperature (H.O.T.) 7. Broken lines on the lower end of the fusing latitude range arrows in FIG. 3 represent marginal quality or level of fix as indicated by tape and crease measurements and indicates experimental errors in fusing measurements when fusing tests are carried out individually or at different times. A styrene-butadiene copolymer having an 89:11 weight ratio of styrene to butadiene indicated by control sample U also shows some variation in HOT as shown by the dotted line at the top end of the fusing latitude arrow in FIG. 3. In general, it is more difficult to define the MFT for polydisperse resins compared with those of mondisperse resins of the present invention. Resin composition and glass transition temperatures ($T_g$) of monomodal resins and blends thereof of the present invention were between about 52° and 58° C. as shown in Table 1. Fusing errors could be minimized by conducting the fusing evaluations of all materials at the same time using the same fuser under the same fusing conditions, and these results are summarized in Table 3. Fusing properties of toners made with resin and resin blend materials of the present invention were noted as follows. Image gloss of fused toner images is dependent on: the surface texture of the fuser roll; the molecular weight and molecular weight distribution of the resin; the toner resin $T_g$; and the surface texture of the paper receiving the toned image. Glossy images in embodiments are preferably obtained with smooth textured fuser rolls since rough rolls lead to non-glossy images. Smooth paper is preferred for glossy images and Hammermill laser print paper was used in the Examples as were smooth glossy fuser rolls having either silicone or Viton® coatings. High gloss images are preferably obtained with low $T_g$ resins having low molecular weights, and there is an optimum gloss fusing latitude, that is, the difference between a point of 10 gloss units and hot offset temperature, which is dependent on fusing conditions, in particular, fuser roll design and roll speed. When $T_g$ is fixed or constant, toners with lower molecular weights have higher gloss values under the same fusing conditions. The crease minimum fix temperature is dependent on $T_g$ and not molecular weight.

Minimum fix temperature as measured by the known crease test is determined by $T_g$. Minimum fix temperature at 10 gloss units is dependent on both $T_g$ and molecular weight. Fusing latitude as determined by the crease test is dependent on $M_w$. Gloss fusing latitude was optimized for resins with $M_w$ near 17,000 under the test conditions of 3 inches per second using a glossy hard Xerox 5028 TM silicone coated fuser roll. For monomodal resins, gloss fusing latitude and crease fusing latitudes are optimized for styrene-butadiene resins with $M_w$ near 30,000. For resins with broad molecular weight distributions, crease minimum fix temperature and gloss minimum fix temperatures at a point of 10 gloss units are nearly the same. Thus improved gloss control is achieved with monomodal, monodisperse resins of the present invention. Optimum values of fusing latitude and minimum fix temperature by gloss and crease are dependent on resin class. However, within a specific resin class, optimum control of fusing properties is best achieved with monomodal, monodisperse resins. Crease fusing latitude, that is the difference between a specific crease value and hot offset, is dependent on $M_w$ and achieves a maximum value near 45,000 and for specific resin designs at fixed $T_g$. An optimum resin design maximizes the fusing latitudes as determined by both crease and gloss and is dependent on resin structure. For styrene-butadiene copolymers, the optimum $M_w$ is 30,000 for maximum crease and gloss toner characteristics. Optimization of toner performance properties is preferably controlled by using monomodal, monodisperse resins of the present invention made with, for example, polystyrene-butadienes, polyacrylates, polymethacrylates, polyesters and polycycloolefins having polydispersities values of less than about 2.0 and which resins are superior in performance properties compared to resins with broad molecular weight distributions of greater than about 2. The performance properties of a toner resin are restricted by molecular weight constituents or components and which properties are preferably controlled when all the components in the toner resin are the same or are nearly the same, that is, as with monomodal, monodisperse resins.

FIG. 3 shows that fusing latitude as measured by gloss remains nearly constant with increasing molecular weight of unblended materials A, B, C, D and E only. There was observed only a very subtle 10 degree Fahrenheit increase in gloss fusing latitude when polymer number average molecular weight ($M_n$) was increased from 20,000 to 40,000 (Sample E). Thus, crease HOT values are coupled to or are influenced by molecular weight while gloss fusing latitude remains nearly independent of molecular weight. This happens it is believed because gloss 10 usually takes place when the toner resin viscosity achieves about $10^4$ poise and hot offset usually takes place at about $4.5\times10^3$ poise. This viscosity difference is really quite small between resins which are useful as toner materials. Additionally, the lowest melting resins at constant $T_g$ with the lowest melt viscosities, optimum mechanical properties, and broad fusing latitudes are achieved with monomodal, monodisperse resins. Although not wanting to be limited by theory it is believed that $T_g$ is usually dependent on molecular weight, and polymers or copolymers with broad molecular weight distributions are usually made up of components with a distribution of $T_g$ values which are typically measured as an averaged $T_g$ value. An averaged $T_g$ value manifests itself in poorer fusing and in failed blocking tests. A monomodal anionic styrene-butadiene resin with a $T_g$ at 53.5° C. ($M_n$ 20,000) passes the 115° F. blocking test, whereas a polydisperse resin like poly(styrene-43-wt. %-n-butyl methacrylate) with a $T_g$ at 57° C. and $M_w$ 46,000 fails the 115° F. blocking test.

The gloss fusing latitude is nearly independent of molecular weight at constant $T_g$. This is especially true for polymers with GPC weight average molecular weights greater than 20,000 and less than 60,000. Unexpectedly, the addition of a high molecular weight polymer component forming a blend did not markedly improve the crease fusing latitude of low molecular weight polymers in toners made with blends of high and low molecular weight polymers. For example, as observed with samples M, N, O, P, Q, R, S, and T of FIG. 3 and Table 1.

The fusing evaluation of three cyan toners with intermediate, low, and high $M_w$ resins was carried out using a Xerox model 5775 TM color fixture using the following protocol. A standard 5775 fuser operated at: 11 inches per second; constant toner mass area equal to $1.2\pm0.2$ mg/cm$^2$ on Hammermill laser print paper with the wire side up; fuser process speed equal to 160 mm/sec.; and an amino-functional silicone release oil at oil rate equal to $25\pm2$ mg per sheet. A monomodal poly(styrene-butadiene) low $M_w$ toner ($M_w$ 25,800, $M_n$ 20,400, butadiene 24.6%, 1,2 vinyl 90.5%, $T_g$ 51.5° C.) matched the gloss fusing temperature characteristics of a fumaric acid-cyclohexanediol-bisphenol A ($M_w$ 8,500, $M_n$ 2,600, $T_g$ 66° C.) available from Dianippon Chemical Co., based polyester toner that was also a monomodal resin with 50 gloss units at 138° C., 60 gloss units at 143° C., and 70 gloss units at 148° C. A monomodal poly(styrene-butadiene) high $M_w$ toner ($M_w$ 62,700, $M_n$ 40,200, butadiene 23.7%, 1,2 vinyl 87.8%, $T_g$ 53.7° C.) produced matte images at low temperatures and gloss images at higher temperatures. The fusing temperature was 50 gloss units at 167° C., 60 gloss units at 170° C. and 70 gloss units at 177° C. An monomodal poly(styrene-butadiene) intermediate molecular weight ($M_w$ 33,800, $M_n$ 26,600 butadiene 24.2%, 1,2 vinyl 87.3%, $T_g$ 52.5° C.) toner between the high gloss and low gloss resin achieved 50 gloss units at 149° C., 60 gloss units at 153° C., and 70 gloss units at 158° C. All three of these toners eventually achieve nearly the same peak or maximum gloss values ($81\pm3$ gloss units), but higher fusing temperatures are required with the higher $M_w$ toners to achieve peak gloss. The gloss versus fusing temperature curve of FIG. 2 is controlled by subtle differences in $M_w$. The fusing temperature to achieve a crease 65 fix level for the three toners were as follows: 145° C. ($M_w$ 25,800), 140° C. ($M_w$ 33,800), and 136° C. ($M_w$ 62,700).

Glossy or matte images can be simultaneously achieved by thermal fusing or pressure fixing toner images at the same minimum fusing temperature for two or more toners made with different $M_w$ resins with comparable $T_g$ values. The $M_w$ difference of the different resins with comparable $T_g$ values is at least of from about 1,000 to about 5,000 and preferably of from about 5,000 to about 20,000. A larger $M_w$ difference leads to a greater difference between gloss properties of the resulting fused images. This is the principle behind dial-a-gloss toners as disclosed herein, and this is demonstrated in embodiments in, for example, Example III and as tabulated in Table 2.

Useful fusing latitudes were chosen between the MFT taken at 10 gloss units using a 75-degree VWR gloss meter and the HOT. Fusing was carried out using a Xerox model 5028 TM fuser operated at 3.1 inches per second. Gloss 10 was selected as MFT because the fuser set temperatures for a Xerox model 1075 TM and 5090 TM toner at gloss 10 with the Xerox 5028 TM fuser system best correlate to the MFT at 65 crease units measured with a Xerox 1075 TM photocopier using a 1075 silicone fuser system operated at 11 inches per second. It appears that fusing latitudes as determined by gloss measurements are nearly constant at 20° C. and are independent of polymer number average molecular weights between 20,000 and 40,000. The use of monomodal, mondisperse resins in toners allows for the design of specific gloss behavior, for example, high gloss for pictorial color applications and low gloss for matte finish for text applications, without reducing fusing latitude. Thus, one important advantage to monomodal or mondisperse resins in xerographic toners is that gloss levels may easily be selected and controlled based on the selection of molecular weight properties of the polymeric toner resins. High gloss properties are primarily determined by low weight average molecular weight polymers. The benefits of high gloss pictorial color xerography include photofinish quality images with generally preferred aesthetic appeal as determined by industry marketing studies.

Monomodal polymers, copolymers and blends thereof of the present invention may be prepared by the methods and materials disclosed in U.S. Pat. No. 5,130,377, U.S. Pat. No. 5,158,851 and copending application U.S. Ser. No. 07/843,051 and filed Feb. 28, 1992, the disclosures of which are incorporated by reference herein in their entirety.

Illustrative examples of monomers for resin polymers or copolymers include a number of known components such as olefins including styrene and its derivatives such as alpha-methyl styrene, butadiene, cycloolefins, isoprene, acrylates, methacrylates, and the like, and mixtures thereof. Specific examples of monomers include styrene, alkyl substituted styrenes, and the like, and mixtures thereof. The resin or resin blends should be present in a sufficient amount to impart the aforementioned desired performance properties to the toner composition. Thus, the resin or resin blend is present in amounts of from about 50 to about 95 weight percent, and preferably from about 70 to about 90 weight percent, based on the total weight of the toner composition.

Illustrative examples of known anionic initiators that can be selected for the preparation of the toner resins include lithium/naphthalene, n-butyllithium, sec-butyllithium/diisopropenylbenzene, n-butyllithium/alphamethyl styrene, and the like, and mixtures thereof. The concentration of the anionic initiator selected may be of from about 0.1 to about 10 molar equivalent percent and preferably of from about 1.0 to about 5.0 molar equivalent percent with respect to the total monomer molar equivalents to be polymerized and depending on the molecular weight desired. Moreover, various monomodal, monodisperse polyesters, polyacrylates, and polystyrene based copolymers are expected to show improved gloss performances as described herein. Monodisperse polyacrylates or methacrylates can be made anionically at low temperature, less than 0° C., or at warmer temperatures above 0° C., using known group transfer polymerization techniques. Polyesters may be prepared by known condensation polymerization techniques.

The aforementioned monomodal resin materials are formulated into toner compositions using known techniques, amounts of resins and performance additives.

Generally, from about 1 part to about 5 parts by weight of toner particles are mixed with 100 parts by weight of known carrier particles to enable a developer. The toner can be subjected to known attrition and classification for the purpose of enabling the toner particles with a known average size diameter of from about 5 to about 25 microns, and preferably from about 9 to about 15 microns.

Numerous well known suitable pigments or dyes can be selected as the colorant for the toner particles including, for example, carbon black, like Regal 330®, channel black, Vulcan black, nigrosine dye, lamp black, and mixtures thereof. The pigment, which is preferably carbon black, should be present in a sufficient amount to render the toner composition highly colored. Thus, the pigment particles are present in amounts of from about 5 percent by weight to about 15 percent by weight, and preferably from about 2 to about 10 weight percent based on the total weight of the toner composition, however, lesser or greater amounts of pigment particles can may be selected.

When the above illustrated pigment particles are mixed with magnetites, which magnetites are known and can be comprised of a mixture of iron oxides ($FeO \bullet Fe_2O_3$) including those commercially available as Mapico Black, the mixtures are present in the toner composition in for example, an amount of from about 10 percent by weight to about 50 percent by weight, and preferably in an amount of from about 12 percent by weight to about 25 percent by weight. In an embodiment of the present invention, the toner can be comprised of a mixture of magnetite, of from about 12 to about 20 weight percent, and pigment, such as carbon black, in an amount of from about 4 to about 15 weight percent. In another embodiment of the present invention, the toner can be comprised of a mixture of magnetite of from about 25 to about 35 weight percent, and pigment, such as carbon black, in an amount of from about 2 to about 10 weight percent.

Also encompassed within the scope of the present invention are colored toner compositions comprised of a toner blend and as pigments or colorants, red, blue, green, brown, magenta, cyan and/or yellow particles, as well as mixtures thereof. More specifically, illustrative examples of magenta materials that may be selected as pigments include 1,9-dimethyl-substituted quinacridone and anthraquinone dye identified in the Color Index as Cl 60720, Cl Dispersed Red 15, a diazo dye identified in the Color Index as Cl 26050, Cl Solvent Red 19, and the like. Examples of cyan materials that may be used as pigments include copper tetra-4-(octadecyl sulfonamido) phthalocyanine, X-copper phthalocyanine pigment listed in the Color Index as Cl 74160, Cl Pigment Blue, and Anthrathrene Blue, identified in the Color Index as Cl 69810, Special Blue X-2137, and the like; while illustrative examples of yellow pigments that may be selected are diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimethoxy-4-sulfonanilide phenylazo-4'-chloro-2,5-dimethoxy acetoacetanilide, permanent yellow FGL, and the like. These pigments are generally present in the toner composition in an amount of from about 1 weight percent to about 15 weight percent based on the weight of the toner resin particles.

The toners may contain a wax with, for example, an average molecular weight of from about 500 to about 20,000 and preferably from about 1,000 to about 6,000, examples of which include polyethylenes, polypropylenes, and the like, reference for example British Patent 1,442,835, the disclosure of which is totally incorporated herein by reference, and U.S. Pat. No. 4,556,624, the disclosure of which is totally incorporated herein by reference. Specific waxes include Viscol 660-P, Viscol 550-P available from Sanyo Kasei K.K., Epolene N-15, and the like. Generally, the wax is present in an effective amount of, for example, from about 1 to about 15, and preferably from about 2 to about 10 weight percent. While not being desired to be limited by theory, it is believed that the wax has a number of functions including enabling an increased fusing latitude, 250° F., for example, increased stripping performance, and as a lubricant.

The toner composition may also include other surface additives, in an effective amount of, for example, from about 0.1 to about 5, and preferably from about 0.1 to about 1.5 weight percent, such as colloidal silicas, including AEROSIL ® R972, metal salts or oxides such as titanium oxide, magnesium oxide, tin oxide, surface treated and untreated composite metal oxide particles disclosed in copending application U.S. Ser. No. 07/976,597 filed Nov. 16, 1992, and the like, which metal oxides can assist in enabling negatively charged toners, and metal salts of fatty acids, such as zinc stearate, magnesium stearate, and the like, reference U.S. Pat. Nos. 3,655,374; 3,720,617; 3,900,588 and 3,983,045, the disclosures of which are totally incorporated herein by reference. While not being desired to be limited by theory, it is believed that the surface additives, especially the silicas, enable excellent toner flow characteristics, enhanced and stable triboelectric values, improved stable admix characteristics, and the like.

The toner compositions of the present invention can be prepared by a number of known methods including melt blending the toner resin particles and pigment particles, or colorants, wax, and silane surface treated metal oxide or silica charge additive, in an extruder followed by mechanical attrition. Other methods include those well known in the art such as spray drying, Banbury melt mixing, and the like. In one extrusion method, a dry bend of the toner components is added to the extruder feeder, followed by heating, to enable a melt mix, which heating in some instances is accomplished at 450° F., and shearing in an extruder, such as the Werner Pfleiderer ZSK 53, cutting the strands of toner exiting from the extruder, and cooling the resulting toner in, for example, water. Thereafter, the toner may be attrited with, for example, an attritor available from Alpine Inc., and classified with, for example, a Donaldson classifier, resulting in toner particles with an average diameter as indicated herein, and in an embodiment of from about 9 to about 20 microns, for example. There can then be added to the resulting toner product surface additives by mixing, for example, in a Lodige Blender the toner and additives, such as composite metal oxide particles with or without a surface or, for example, AEROSIL ®, wherein the surface additives particles may be mechanically impacted on and into the toner surface or alternatively the surface additive particles are dispersed throughout and onto the toner particle surfaces by mild blending wherein the surface additives are not fixed to the surfaces of the toner particles. The developer compositions can then be prepared by mixing in a Lodige blender the toner with surface additives and carrier particles for effective mixing times of, for example, from about 1 to about 20 minutes.

The toner and developer compositions of the present invention may be selected for use in electrostatographic imaging processes containing therein conventional photoreceptors, including inorganic and organic photoreceptor imaging members. Examples of imaging members are selenium, selenium alloys, and selenium or selenium alloys containing therein additives or dopants such as halogens. Furthermore, there may be selected organic photoreceptors, illustrative examples of which include layered photoresponsive devices comprised of transport layers and photogenerating layers, reference U.S. Pat. No. 4,265,990, the disclosure of which is totally incorporated herein by reference, and other similar layered photoresponsive devices. Examples of generating layers are trigonal selenium, metal phthalocyanines, metal free phthalocyanines and vanadyl phthalocyanines. As charge transport molecules, there can be selected the aryl diamines disclosed in the '990 patent. Also, there can be selected as photogenerating pigments, squaraine compounds, thiapyrillium materials, titanyl phthalocyanines, especially Type I, Ia, IV, and the like. These layered members may be charged negatively or positively, thus requiring a charged toner of opposite charge. Moreover, the developer compositions of the present invention are particularly useful in electrostatographic imaging processes and apparatuses wherein there is selected a moving transporting means and a moving charging means; and wherein there is selected a deflected flexible layered imaging member, reference U.S. Pat. Nos. 4,394,429 and 4,368,970, the disclosures of which are totally incorporated herein by reference.

Images may be obtained with developer compositions of the present invention which have acceptable solids, excellent halftones and desirable line resolution with acceptable or substantially no background deposits at, for example, a relative humidity of from about 10 to about 90 percent as determined, for example, by known standard visual and optical copy quality characterization methods.

The following examples are being submitted to further define various species of the present invention. These examples are intended to be illustrative only and are not intended to limit the scope of the present invention.

The following examples were performed with copolymers prepared by anionic living copolymerizations wherein the molecular weight, composition or monomer ratio and content, and glass transition temperatures were carefully controlled and polydispersities or the ratio of weight average to number average molecular weight, were from about 5,000 to about 65,000.

EXAMPLE I

Anionic copolymers with the properties summarized in Table 1 was prepared. A typical 1-liter beverage bottle preparative polymerization reaction procedure follow.

Preparation of Lithium/Naphthalene Initiator. To a 1-liter, one-neck flask were added naphthalene (45 g) and lithium shot (5.1 g) in mineral oil. The flask was equipped with a magnetic stir bar, and was then capped with a rubber septum. After an argon purge, freshly distilled tetrahydrofuran (300 mL) was then added by cannula under argon and the mixture was stirred for 16 hours. The molarity of this initiator solution was 2.38 molar, as determined by an average of the GPC molecular weight results from six polymerization reactions. The molarity of the solution was determined with the following equation: $M=[4000\times\text{grams of monomer}]\div[\{\text{mL of initiator solution}\}\times\{\text{the molarity of the initiator solution}\}]$.

Preparation of Anionic Styrene-Butadiene Copolymer with Lithium/Naphthalene Catalyst. A 1-liter beverage bottle was equipped with a stir bar and rubber septum. After an argon purge, tetrahydrofuran (300 mL, 262.7 g) and cyclohexane (350 mL, 268.1 g) were added by cannula under argon. Lithium/naphthalene initiator solution (approximately 0.5 mL) was added dropwise until the solution was light yellow-green. More 2.38 molar lithium/naphthalene solution (11 mL) was then added by syringe. After cooling the beverage bottle reactor in a dry ice/2-propanol bath at −30° C., styrene (91.6 g, 100 mL) and butadiene (29.1 g, 43 mL) combined were added over 5 minutes under argon. After 16 hours, 2-propanol (30 mL) was added and the reaction mixture was added to 2-propanol (1-gallon) to precipitate the product using a Waring blender. The polymer was isolated by filtration, washed with methanol (500 mL), and vacuum dried. The polymer dissolved in methylene chloride (20 weight percent solids) was added to methanol (1 gallon). The white polymeric product was collected by filtration and vacuum dried. The resultant polymer (obtained in 96% yield) was comprised of 77.52 weight percent styrene and 22.48 weight percent butadiene with 78.1% of the butadiene content as the 1,2-vinyl regioisomer, as determined using $^1$H NMR spectrometry. The monomodal GPC $M_w/M_n$ was 26,162/18,499, and the glass transition temperature ($T_g$) was 50.3° C. as determined by differential scanning calorimetry. The copolymer product was made into toner by extrusion at 130° C. with 6 wt. % Regal 330 carbon black and 2 weight percent cetyl pyridium chloride charge control agent followed by micronization. The MFT of the resulting toner was 124° C. and the HOT was 146° C. using a Xerox 5028 TM silicone roll fuser operated at 3.3 inches per second. The resins and toners thereof reported in Tables 1, 2 and 3 were prepared as described above. The blends reported in Tables 1 and 2 were made by precipitating a methylene chloride solution of two blended copolymers at 20 weight percent solids into methanol using a Waring blender. The copolymers and their respective blends have properties summarized in Tables 1, 2 and 3.

EXAMPLE II

Scaled-Up Preparations of Anionic Styrene-Butadiene Copolymers. A 50-liter flask equipped with a mechanical stirrer, argon inlet and a stainless steel thermocouple lead was situated in a dry-ice methanol bath and cooled to −30° C. Tetrahydrofuran (THF), freshly distilled over sodium benzophenone ketyl, and cyclohexane, distilled over calcium hydride, were added. Lithium/naphthalene initiator solution was added until the solvent mixture in the reaction vessel remained light green. Styrene, freshly distilled over calcium hydride, was collected in a round-bottom flask which was then stoppered with a rubber septum. Butadiene, as received (Phillips Petr. Co.), was bubbled into the cold styrene, situated in an ice bath, using Tygon tubing and a syringe needle until the appropriate combined weights of styrene and butadiene were obtained. Lithium/naphthalene initiator solution was added to the green solvents using a graduated cylinder and a stainless steel double-ended needle under argon. The combined monomers were added to the solvent and initiator at −30° C. over approximately 90 minutes with stirring. An exothermic reaction took place and dry ice was added to maintain the reaction temperature below −6° C. After more than 4 hours, and preferably 8 hours, methanol (100 mL) was added and the reaction mixture was added to isopropanol (50 gallons) to precipitate the polymer. The polymer was isolated by filtration, washed with methanol (5 gallons) and then vacuum dried until no volatiles were detected by gas chromatography. The yield of white polymer powder was typically more than 96%.

Toner Preparation. Toners were prepared by Banbury roll mill or extrusion using a ZSK extruder, followed by jet mill attrition, and then classified to 10 microns (number average as determined with Laysen cell analysis). The copolymers were characterized by $^{13}$C and $^1$H NMR spectrometry, differential scanning calorimetry (DSC) and gel permeation chromatography (GPC).

NMR Structure Determinations. The anionic copolymer structure with cis-, trans- and vinyl-butadiene stereo- and regio-isomers is shown below. In embodiments, there are approximately 2 butadienes for every 3 styrenes in the copolymer chain.

$^{13}$C and $^1$H NMR spectrometry are the methods of choice for determining styrene and butadiene compositions, (cis-, trans- and vinyl-) butadiene stereo- and regio-chemistry, and end groups. The 1,2vinyl-allylic $CH_2$ protons are found at 4.95 ppm, and the vinyl-, cis-, and trans-vinylic -CH=protons are found at 5.36 ppm. Styrene aromatic protons are found at 6.66 (ortho) and 7.13 ppm (meta and para). The ratio of styrene to butadiene protons is used to calculate the weight percent butadiene, and the ratio of 1,2-vinyl to butadienyl protons is used to calculate the percent 1,2-vinyl groups to within ±5%. Butadiene contents measured in the copolymers are approximately the same as the amounts charged in the reaction mixture with some adjustment for loss (up to 1 weight percent) due to butadiene leakage during the reaction. Butadiene loss typically occurred when the reaction vessel was not pressurized.

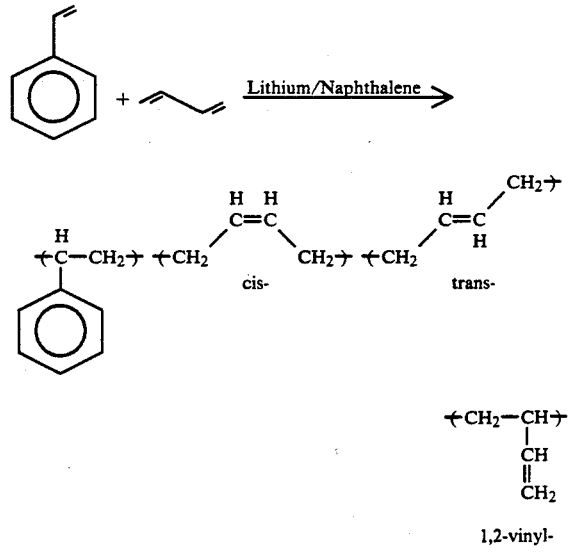

A fixed 49.42 weight percent-THF/cyclohexane ratio in the reaction was used to regulate the number of 1,2-vinyl groups in the anionic copolymers. $^1$H NMR spectrometry was used to determine the ratio of 1,2-vinyl groups at 85±5 weight percent. THF enhances anionic polymerization rates and acts as a catalyst for 1,2-vinyl-butadiene enchainment. THF also is a known polar modifier, a 1,2-vinyl-butadiene director and a randomizing agent.

Butadiene Copolymer End Group Identification. Because the number of butadienyl end groups determined by $^{13}C$ NMR coincides with the number of end groups calculated by GPC $M_n$ analysis, the copolymer end groups were determined to be exclusively derived from butadiene and not styrene. This observation might be related to the reactivity ratios of styrene and butadiene under the reaction conditions used, or alternatively, gaseous butadiene in the reactor head space might have redissolved in the reaction mixture and reacted at the end groups after all the styrene had reacted.

Tailored Copolymer $M_n$ and $T_g$ Values. Molecular weight ($M_n$) and $T_g$ control are two major advantages of preparing toner resins using anionic polymerization processes. Anionic styrene-butadiene copolymers with specific $T_g$ and $M_n$ values were prepared and DSC was used to determine copolymer $T_g$ values. GPC was used to determine copolymer molecular weights. Copolymer monomodal molecular weights ($M_n$) were selected between 3,000 and 100,000, the weight percent butadiene in the materials was selected between 16 and 35 weight percent of the copolymer weight, and the $T_g$ values were between 40° and 62° C. The unique monomodal character of anionic copolymers with specific $T_g$ values allows molecular weight effects to be separated from $T_g$ effects in toner fusing studies as demonstrated herein.

Monomodal Copolymer $T_g$ Related to Percent Butadiene Content. Sharp glass transition temperatures were measured for the anionic polymerization prepared copolymers. Sharp glass transition temperatures are usually indicative of a random distribution of monomers throughout a copolymer chain. The glass transition temperature of random anionic styrene-butadiene copolymers depends on the weight percent butadiene in the resin, the 1,2-vinyl-butadiene content, and the molecular weight of the copolymer.

$T_g$ of Random Anionic Styrene-Butadiene Copolymers Is Relatively Insensitive to Molecular Weight. A plot of $T_g$ versus number average molecular weight ($M_n$) for anionic styrene-butadiene copolymers of the present invention, prepared with nearly the same weight percent butadiene (23+/−1) and with 80 and 87 weight percent 1,2-vinyl group content surprisingly showed that $T_g$ is remarkably linear and insensitive to molecular weight and shows only a three degree difference over the range 37,000 to 82,000 ($M_n$). In polystyrene samples, standards available from Pressure Chemical Co., Pittsburgh, PA, show approximately 30° C. difference over about the same molecular weight range ($M_n/T_g$: 3,500/63; 10,200/85; 97,200/93).

EXAMPLE III

Laboratory Toner Preparation and Toner Fusing Evaluation. Toners were prepared by extrusion using a CSI mixing extruder and jetting with a Trost Gem T jet mill (Garlock Industries). Polymer, 92 percent, 6 percent of Regal 330 ® carbon black and 2 percent of CPC (cetyl pyridinium chloride charge additive) were extruded at 130° C. followed by micronization of the extrudate to 8 microns. Particle size analysis was carried out using a Coulter Counter and by Laysen particle size analysis.

The minimum fix temperature was determined with a Xerox Corporation model 5028 TM silicone fuser roll operating at 3.1 inches per second. Roll temperature was determined using an Omega pyrometer and was checked with wax paper indicators. Alternatively, fusing was carried out at 11 inches per second using a Xerox 1075 TM fuser, or a Xerox 5775 fuser operated at 11 inches per second.

The triboelectric values against a carrier comprised of steel coated with polyvinylidene fluoride, 0.75 percent, after 0.5 hour on a roll mill were, for example, about 30 microcoulombs per gram at 3 percent toner concentration as measured with a standard known Faraday Cage apparatus.

The minimum fix temperature of the toner was determined by known crease, gloss, tape and Pink Pearl erasure tests. The crease test is the analysis of the cracking of the fused toner images when a solid area image at 0.9 to 1.1 grams of toner per gram of paper (g/g), was folded 180 degrees with the image side inward. When unfolded, the crease area was microscopically observed visually and using a densitometer then compared to Xerox Corporation 1075 TM imaging apparatus fix standards. When fused with a Xerox 5028 TM silicone roll fuser operated at 3 inches per second, the minimum fix temperature was taken at 20 crease units. When a Xerox 1075 fuser operated at 11 inches per second was used, the minimum fix temperature was taken at 65 crease units.

Gloss of fused toner images was measured as a function of fuser surface temperature using a VWR 75°-gloss meter available from VWR Corp. Fusing temperatures of the various toners were compared at 10 gloss units or "gloss 10" selected as an arbitrary standard of reference.

The minimum fix temperature of a toner using the tape test was determined when a peppered toned image was removed with SCOTCH ® Tape Magic 810.

The minimum fix temperature by the known Pink Pearl ® erasure test was determined to be the lowest fuser surface temperature at which the fused toner image was indelible to repeated and consistent rubbing.

The hot offset temperature was determined when the toned image stuck to the silicone roll fuser as indicated when fused. Toner images were observed to offset from paper onto a silicone fuser roll, and then were imprinted onto the same or subsequent paper copy sheets.

EXAMPLE IV

Preparation of Cyan Toners. The copolymers of Example I and II were combined with 2 percent of PV Fast Blue and the mixture was masticated in a Brabender melt mixer (plastograph) for 12 minutes at 100° C. The resultant plastic was jetted into toner between 8 and 10 microns and rolled against Xerox Corporation 1075 ® carrier. Images were developed on Hammermill laser print paper and on MYLAR ® transparency stock (treated with ethanol and air dried) using a solid area imaging device. The solid area imaging device consisted of a capacitor made with an aluminum plate (negative electrode) and NESA-glass positive electrode. Toner and carrier were cascaded onto paper situated between the two charged plates until constant toner mass areas between 0.9 to 1.1 grams of toner per gram of paper (g/g) were obtained. Fusing was then carried out using a Xerox 5028 smooth, glossy, hard silicone roll fuser operated at 3.1 inches per second.

EXAMPLE V

Anionic Copolymer Blends. For theoretical reasons relating to chain entanglement, fusing latitude of xerographic toners should increase with increasing toner polymer $M_w$. Two unsuccessful attempts were made to increase $M_{z+1}$ (as measured with a Waters GPC algorithm) and to enhance fusing latitude with blends of high and low molecular weight copolymers. Both blends added 10 weight percent, 80,000 $M_n$ copolymer to 90 weight percent, 20,000 $M_n$ copolymer.

One blend comprised a random anionic styrene-butadiene copolymers that combines a monomodal resin with $M_n$ 20,360, $M_w$ 25,810 and $T_g$ 51.5° C. with a monomodal resin with $M_n$ 76,900, $M_w$ 103,600 and $T_g$ 54.3° C. Another blend consists of a monomodal resin with $M_n$ 20,670, $M_w$ 25,080 and $T_g$ 56.7° C. with a monomodal resin with $M_n$ 79,200, $M_w$ 111,500 and $T_g$ 57.6° C. The blends were formed in 20 weight percent methylene chloride solution and isolated by precipitation into methanol followed by vacuum drying. There was only a slight increase in $M_w$ of the blend, of only 23% or 6,000 $M_w$ units, compared with the unblended low $M_w$ copolymer. Therefore, only small fusing latitude enhancements can be expected. An improved method to increase copolymer $M_w$ and to enhance fusing latitude is polymer chain coupling by the addition of silane coupling agents, for example, dichlorodimethylsilane, to the living copolymers near the end of the copolymerization reaction reference the aforementioned copending application Ser. No. 07/843,051. In laboratory tests, chain coupling using silanes was a much more effective method to increase copolymer $M_w$ than a physical blend approach described herein. For example, an anionic copolymer, with $T_g$ 50.3° C. and GPC $M_w/M_n$=26,200/18,500, was treated with dichlorodimethylsilane (0.6 weight percent of copolymer) to yield a silane coupled copolymer with $T_g$ 50.5° C. and GPC $M_w/M_n$=48,300/23,800. The $M_w$ of the coupled copolymer was nearly twice the $M_w$ of the uncoupled copolymer, while the $T_g$ of the two copolymer materials remained unchanged.

EXAMPLE VI

Toner Processing and Jetting of Anionic Copolymers. Anionic copolymers and blends were formulated with 6 weight percent Regal 330® and 2 weight percent CPC charge additive, or with 2 weight percent PV. Fast Blue, and were then melted, blended and jetted into toner. The toner formulations were prepared by Banbury rubber roll mill and by extrusion (ZSK Extruder). The jetting rates decrease logarithmically with increasing polymer molecular weight ($M_w$). Jetting rates also decrease with increased butadiene content in the resins. The copolymers, with $M_w$ 30,000 or less, jet rapidly, whereas, as higher molecular weight material ($M_w$ 62,700) jets more slowly than a suspension styrene-13 weight percent 1,4-butadiene copolymer control. The control with 118,000 $M_w$ jets between 10 and 15 grams/minute. Fast jetting rates and small toner sizes are best achieved with low $M_w$ materials. The advantages of faster jetting rates achieved with low $M_w$ copolymers must be weighed against toner performance feature issues such as reduced developer life and decreased fusing latitudes expected with low $M_w$ toners.

Another method to expedite jetting rate and to reduce toner particle size is to add 4 weight percent Polywax 2000 to the toner formulations. Polywax 2000 (P2000) is a low molecular weight, semicrystalline polyethylene wax available from Petrolite Corp. For example, a cyan toner made with an anionic styrene-24.0 weight percent—butadiene copolymer having $M_w$ 21,900, $M_n$ 16,300, $T_g$ 52.7° C., $T_f$ 50.4° C., 88.7 weight percent 1,2-vinyl content, and 2 weight percent PV Fast Blue was jetted at 30 grams per minute to obtain 10.6 micron particles. By comparison, the same toner formulation with 4 weight percent P2000 was jetted at the same rate, and 8.74 micron particles were obtained. Besides improved jetting, P2000 improves the fusing latitude of low melt toners in laboratory fusing studies. However, using P2000 may, however, lead to more difficulty in processing and reduced powder flow. When P2000 is added to toner formulations, melt mixing with a Banbury mixer and rubber roll mill is recommended, rather than extrusion, to promote wax dispersion and to reduce the amount of free wax observed in the toner. Moreover, the use of surface treatments with 0.5 weight percent AEROSIL® is required to effectively improve powder flow in toners containing P2000.

EXAMPLE VII

Toner Blocking Temperature Dependence on Copolymer $T_g$. Toner blocking occurs when heated toner clumps or cakes together in machines or during elevated temperature storage. A controlled toner blocking test was carried out and blocking temperatures are those at which the anionic toners became slightly caked but breakable or friable after 24 hours. Toner blocking temperature versus toner $T_g$ is a linear plot. Toners with a $T_g$>51.5° C. pass the blocking test at 110° F. A toner $T_g$ of 54° C. is required to pass the blocking test at 115° F. CPC charge additive (2 weight percent) in the toners generally decreases the blocking temperature of the toners. The Xerox 1075 TM toner with a $T_g$ of 56.9° C. almost passes requiring a $T_g$ of 58° C. to pass the blocking test at 115° F., and serves as a commercial sample as a control standard for comparison.

Other modifications of the present invention may occur to those skilled in the art subsequent to a review of the present application, and these modifications are intended to be included within the scope of the present invention.

TABLE 1

Physical Properties and Fusing of Monodisperse Polymers and Blends

| Sample | Blends wt. % comp. | Calcd. $M_n$ | GPC $M_n/M_w$ (K) | PD[d] | Wt. % BD[e] | % 1,2 vinyl[f] | MFT crease ≦20° F. | MFT tape ≦3° F. | HOT °F. | Resin $T_g$ °C. | Toner $T_g$ °C. |
|---|---|---|---|---|---|---|---|---|---|---|---|
| A | | 20K | 22/25 | 1.17 | 21.1 | 87.8 | 260 | 260 | 300 | 56.5 | 56.5 |
| B | | 25K | 19/24 | 1.25 | 22.8 | 85.7 | 260 | 260 | 310 | 54.6 | 54.6 |
| C | | 22K | 20/25 | 1.22 | 21.2 | 80.0 | 270 | 270 | 310 | 53.5 | 55.1 |
| D | | 30K | 26/33 | 1.27 | 21.2 | 85.7 | 280 | 270 | 315 | 52.7 | 54.3 |
| E | | 40K | 38/47 | 1.26 | 24.0 | 81.8 | 270 | 270 | 320 | 51.9 | 52.7 |
| F | | 40K | 37.5/45 | 1.20 | 27.5 | 83.4 | 270 | 270 | 320 | 44.9 | 47.1 |
| G | | 60K | 50/89 | 1.77 | 21.2 | 87.2 | 320 | 290 | >340 | 54.9 | 53.1 |
| H | | 80K | 80/104 | 1.30 | 21.3 | 88.0 | nj[a] | nj | nj | 54.9 | nd[b] |
| I | | 120K | 139/228 | 1.64 | 22.5 | 88.0 | nj | nj | nj | 72.3 | 6.7/7.1[c] |
| J | 95/5 | 28K | 21/30 | 1.43 | 20.9 | 84.1 | 270 | 320 | 360 | 53.7 | 53.9 |

TABLE 1-continued

Physical Properties and Fusing of Monodisperse Polymers and Blends

| Sample | Blends wt. % comp. | Calcd. $M_n$ | GPC $M_n/M_w$ (K) | PD[d] | Wt. % BD[e] | % 1,2 vinyl[f] | MFT crease ≦20° F. | MFT tape ≦3° F. | HOT °F. | Resin $T_g$ °C. | Toner $T_g$ °C. |
|---|---|---|---|---|---|---|---|---|---|---|---|
| K | 90/10 | 45K | 24/45 | 1.90 | 20.9 | 89.9 | 280 | 290<br>280 | 330 | 55.1 | 55.7 |
| L | 80/20 | 41K | 26/42 | 1.65 | 21.5 | 86.0 | 280 | 310<br>280 | 335–<br>40 | 55.7 | 55.9 |
| M | 70/30 | 48K | 25/48 | 1.91 | 21.4 | 81.7 | 290 | 320 | 360 | 53.9 | 53.9 |
| N | 90/10 | 33K | 23/33 | 1.41 | 21.3 | 87.8 | 310 | 310 | 350 | 54.7 | 55.9 |
| O | 95/5 | | 19/28 | 1.34 | | | 260 | 260 | 310 | 55.9 | 56.1 |
| P | 95/5 | | 21/29 | 1.37 | | | 260 | 290 | 320 | 55.9 | 55.9 |
| Q | 95/5 | | 20/32 | 1.62 | | | 270 | 270 | 330 | 55.7 | 55.6 |
| R | 90/10 | | 21/31 | 1.51 | | | 270 | 290 | 325 | 55.9 | 55.5 |
| S | 90/10 | | nd | | | | 280 | 280 | 325 | 55.9 | 56.1 |
| T | 90/10 | | 21/30 | 1.43 | | | 290 | 290 | 325 | 55.7 | 55.5 |
| U | | | 19/134 | 6.46 | 11.0 | 0 | 300 | 300 | 360 | 58.1 | 57.9 |
| V | | | 16/46 | 2.80 | 0 | 0 | 330 | 330 | 380 | 56.9 | 56.9 |

Notes
[a]nj - not jetted
[b]nd - not determined
[c]two glass transitions observed
[d]polydispersity = ratio of $M_w/M_n$
[e]weight percent butadiene
[f]weight percent 1,2 vinyl butadiene of total butadiene

TABLE 2

Gloss and Fusing Properties of Monomodal Resin Toner Compositions

| SAMPLE | Gloss 10[a] | HOT[b] | $M_w/M_n$[c] | PD[d] | $T_g$[e] | wt % BD[f] | F.L.[g] |
|---|---|---|---|---|---|---|---|
| I | 107 | 127 | 9,000/5,000 | 1.8 | 52 | 20 | 20 |
| II | 120 | 143 | 42,300/24,500 | 1.7 | 52 | 24.5 | 23 |
| III | 123–127 | 150–156 | 32,700/21,500 | 1.5 | 55 | 22.2 | 25–29 |
| IV (D) | 132 | 166 | 33,000/26,000 | 1.3 | 54 | 21 | 34 |
| V | 140 | 168–177 | 33,000/25,000 | 1.3 | 53 | 24 | 28–37 |
| VI (E) | 158 | 188 | 47,000/38,000 | 1.2 | 53 | 24 | 30 |
| (U) control | 154 | 182 | 118,000/18,200 | 6 | 58 | 13 | 28 |
| (V) control | 158 | 188 | 45,500/16,300 | 2.8 | 56.9 | 0 | 30 |

Notes
[a]minimal acceptable gloss at temperature in °C.
[b]hot offset temperature in °C.
[c]$M_w$ - weight average molecular weight, $M_n$ - number of average molecular weight
[d]polydispersity = ratio of $M_w/M_n$
[e]glass transition temperature in °C.
[f]weight percent butadiene content
[g]fusing latitude in °C. = Hot Offset Temperature − Minimum Fix Temperature

TABLE 3

Fusing Performance of Low Melt Toners with a High Gloss Xerox 5028 TM Fuser (at 3.1 in/sec.)

| Sample | Initiator[a] | $T_g$ (°C.) | Wt. % Bd | % 1,2-Vinyl | GPC $M_w$ (K) | GPC $M_n$ (K) | Crease (°F.) High Gloss Roll | Tape (°F.) High Gloss Roll | 75°-Gloss 10 | HOT (°C.) | Relative[b] Crease (Gloss) Fix Temp. in °F. | F.L. (°C.) |
|---|---|---|---|---|---|---|---|---|---|---|---|---|
| 1 | nap | 51.5 | 24.5 | 90.5 | 25.8 | 20.4 | 128.4 | 128.6 | 116/132 | 149 | 26 | 21 |
| 2 | nap | 56.6 | 21.3 | 89.4 | 25.1 | 20.7 | 132.4 | 128.6 | 120/130 | 154 | 22 | 22 |
| 3 | nap | 57.3 | 21.9 | 85.7 | 45.2 | 35.9 | 132.4 | 135.0 | 140/148 | 160 | 22(13) | 28 |
| 4 | nap | 69.7 | 21.3 | 93.0 | 61.9 | 47.8 | 137.4 | 141.9 | 150/159 | 171 | 17(3) | 34 |
| 5 | nap | 54.3 | 22.2 | 82.9 | 32.7 | 21.5 | 126.7 | 124.6 | 127/136 | 149 | 28 | 22 |
| 6 | αMS | 58.9 | 19.3 | 88.0 | 46.2 | 34.9 | 135.9 | 165.5 | 147/154 | 166 | 19(6) | 30 |
| 7 | αMS | 58.9 | 18.9 | 84.3 | 35.7 | 31.9 | 133.0 | 148.9 | 133/147 | 160 | 21(20) | 27 |
| 8 | αMS | 47.9 | 23.1 | 85.0 | 12.8 | 9.7 | 119.3 | 121.1 | 100/122 | 127 | 35 | 8 |
| 9 | αMS | 48.9 | 24.0 | 85.0 | 16.8 | 13.3 | 120.1 | 121.1 | 104/121 | 143 | 34 | 23 |
| 10 | BuLi | 51.7 | 23.5 | 85.1 | 26.4 | 21.1 | 128.1 | 126.7 | 115/134 | 149 | 26 | 21 |
| U | control | 58 | 11.0 | 0 | 118 | 18.2 | 137.8 | 136.7 | 147/158 | 171 | 16(6) | 33 |
| V | control | 56.9 | 0 | 0 | 45 | 16 | 154.4 | 154.3 | 153/168 | 171 | 0 | 17 |

Notes
[a]nap = lithium naphthalide
αMS = alpha methyl styrene
BuLi = butyl lithium
[b]relative to control sample V

What is claimed is:

1. A toner composition comprised of pigment particles, and a resin comprised of a monomodal polymer resin or monomodal polymer resin blends and wherein the monomodal resin or resin blends possess a narrow polydispersity.

2. A toner composition according to claim 1 wherein the monomodal polymers have a weight average molecular weight ($M_w$) of from between about 18,000 to about 65,000 and wherein polydispersity or $M_w/M_n$ is between from about 1.0 to about 2.0.

3. A toner composition according to claim 1 wherein the monomodal polymers have a weight average molecular weight ($M_w$) of from between about 5,000 to about 70,000 and wherein $M_w/M_n$ is from between about 1.0 to about 2.0.

4. A toner composition according to claim 1 wherein the pigment is carbon black, magnetite, or mixtures thereof; cyan, yellow, magenta, or mixtures thereof; or red, green, blue, brown, or mixtures thereof.

5. A toner composition in accordance with claim 1 wherein the resin is poly(styrene-butadiene), polyisobutylmethacrylate, polyacrylate, polymethacrylate, polyester, or polyvinyl chloride with a resin polydispersity between about 1.0 and 2.0 and a $T_g$ from between 25° C. and about 60° C.

6. A toner composition in accordance with claim 1 wherein the resin is poly(styrene-1,2-butadiene) having a butadiene content of from between about 10 to about 50 weight percent of the resin.

7. A toner composition in accordance with claim 1 wherein the resin has a glass transition temperature ($T_g$) of from between about 25° to about 65° C.

8. A toner composition in accordance with claim 1 wherein said toner has a glass transition temperature of between about 40° to about 65° C.

9. A toner composition in accordance with claim 1 wherein said toner has a fusing latitude of between about 15° to about 60° C.

10. A toner composition in accordance with claim 1 with a fusing temperature of between about 200° F. to between about 370° F.

11. A toner composition in accordance with claim 1 wherein said toner has a minimum fusing temperature at 65 crease units which is dependent on polymer $T_g$ and is independent of polymer average molecular weight and where the minimum fusing temperature decreases by about 0.2° C. for each 1,000 increase in polymer $M_w$.

12. A toner composition in accordance with claim 1 wherein said toner produces xerographic images wherein the gloss of the images is inversely proportional to the molecular weight of the resin.

13. A toner composition in accordance with claim 1 containing charge enhancing additives present in an amount of from about 0.1 to about 10 percent by weight and selected from the group consisting of alkyl pyridinium halides, organic sulfates, organic bisulfates, organic sulfonates, distearyl dimethyl ammonium methyl sulfate, distearyl dimethyl ammonium bisulfate, cetyl pyridinium lakes, polyvinyl pyridine, treated carbon blacks, tetraphenyl borate salts, phosphonium salts, nigrosine, metal-salicylate salts, metal complexes, polystryene-polyethylene oxide block copolymer salt complexes, poly(dimethyl amino methyl methacrylate), metal azo dye complexes, organo aluminum salts, and colloidal silicas.

14. A toner composition in accordance with claim 13 wherein the charge enhancing additive is present on the surface of the toner composition.

15. A toner composition in accordance with claim 13 wherein the charge enhancing additive is incorporated into the toner.

16. A toner composition in accordance with claim 13 containing a wax component with a weight average molecular weight of from about 1,000 to about 6,000.

17. A toner composition in accordance with claim 1 wherein the triboelectric charge on the toner is from about a positive or negative 5 to about 35 microcoulombs per gram.

18. A developer composition comprised of the toner composition of claim 1, and carrier particles.

19. A developer composition in accordance with claim 18 wherein the carrier particles are comprised of a core of steel, iron, or ferrites.

20. A developer composition in accordance with claim 18 wherein the carrier particles include thereover a polymeric coating comprised of a methyl terpolymer, a polyvinylidine fluoride, a polymethyl methacrylate, or a mixture of polymers not in close proximity in the triboelectric series.

21. A method of imaging which comprises the formation of an electrostatic latent image on a photoconductive member; developing the resulting latent image with a toner composition comprised of pigment particles, and a resin comprised of a monomodal polymer resin or monomodal polymer resin blends; subsequently transferring the developed image to a suitable substrate; and thereafter permanently affixing the image thereto.

22. A method of imaging in accordance with claim 21 wherein the toner composition resin has a $M_w$ of about 26,000 and a $M_w/M_n$ of about 1.3 and provides a resulting affixed image with a high gloss 10 value at 122° C.

23. A method of imaging in accordance with claim 21 wherein the toner composition resin has a $M_w$ of about 63,000 and a $M_w/M_n$ of about 1.6 and provides a resulting affixed image with a low gloss 10 value at 145° C.

24. A method of imaging in accordance with claim 21 wherein the toner composition resin has a $M_w$ of about 34,000 and a $M_w/M_n$ of about 1.3 and provides a resulting affixed image with a intermediate gloss 10 value at 130° C.

25. A method of imaging in accordance with claim 21 wherein the toner composition maintains its electrical characteristics for one million developed copies.

26. A method of imaging in accordance with claim 21 comprising developing the resulting latent image with at least two toner compositions comprised of pigment particles, and a resin comprised of a monomodal polymer resin or monomodal polymer resin blends, wherein the monomodal resin or resin blends of the toner compositions have weight average molecular weight properties that differ by at least $M_w$ of from about 1,000 to 5,000 thereby providing corresponding images with at least two different gloss values when the toner compositions are affixed to the substrate under similar fusing temperatures.

* * * * *